US006683588B1

(12) United States Patent
Chung et al.

(10) Patent No.: US 6,683,588 B1
(45) Date of Patent: Jan. 27, 2004

(54) LOW VOLTAGE DRIVING APPARATUS AND METHOD FOR PLASMA DISPLAY PANEL

(75) Inventors: Moon Shick Chung, Kumi-shi (KR); Nam Kyu Lee, Kumi-shi (KR); Bong Koo Kang, Pohang-shi (KR); Yun Kwon Jung, Pohang-shi (KR); Sang Jin Yun, Pohang-shi (KR); Hee Chan Yang, Pohang-shi (KR); Young Hwan Kim, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 129 days.

(21) Appl. No.: 09/665,946

(22) Filed: Sep. 21, 2000

(30) Foreign Application Priority Data

Sep. 21, 1999 (KR) ..... P99-40818

(51) Int. Cl.[7] ..... G09G 3/28
(52) U.S. Cl. ..... 345/60; 345/211
(58) Field of Search ..... 345/60, 62, 63, 345/66, 67, 68, 204, 205, 206, 211; 315/169.4; 313/581, 585

(56) References Cited

U.S. PATENT DOCUMENTS 4,492,957 A * 1/1985 Marentic ..... 345/69
4,613,855 A * 9/1986 Person et al. ..... 345/60
4,665,345 A * 5/1987 Shionoya et al. ..... 315/169.4
6,008,687 A 12/1999 Orita et al. ..... 327/515
6,028,573 A 2/2000 Orita et al. ..... 345/66
6,097,214 A * 8/2000 Troussel et al. ..... 326/63
6,144,348 A 11/2000 Kanazawa et al. ..... 345/60

FOREIGN PATENT DOCUMENTS

| | | | |
|---|---|---|---|
| JP | 02-92111 | 3/1990 | ..... G09G/3/28 |
| JP | 10-117134 A | 5/1998 | ..... G09G/3/28 |
| JP | 10-247456 | 9/1998 | ..... G09G/3/28 |
| KR | 10-0217276 | 6/1999 | |
| KR | 10-0250407 | 1/2000 | |

* cited by examiner

*Primary Examiner*—Xiao Wu
(74) *Attorney, Agent, or Firm*—Fleshner & Kim, LLP

(57) ABSTRACT

A plasma display panel that is adapted to be driven with a low-level voltage signal. A source electrode is supplied with a voltage and a trigger electrodes is opposed to the source electrode. A first discharge is generated between each source electrode and each trigger electrode to apply a voltage at source electrode to a panel electrode.

30 Claims, 10 Drawing Sheets

LOW VOLTAGE DRIVING APPARATUS AND METHOD FOR PLASMA DISPLAY PANEL

BACKGROUND OF THE INVENTION

1. Field of the Invention

This invention relates to a plasma display panel, and more particularly to a plasma display panel that is adapted to be driven by a low voltage signal.

2. Background of the Related Art

Recently, it has been possible to manufacture a plasma display panel (PDP) of a large-dimension panel. Such a PDP has a number of discharge cells arranged in a matrix. The discharge cells are provided at each of intersections between sustain electrode lines for sustaining a discharge and address electrode lines for selecting a cell to be discharged.

The PDP is largely classified into a direct current (DC) type panel and an alternating current (AC) type panel depending on whether or not a dielectric layer for accumulating a wall charge exists in the discharge cell. The PDP requires a high voltage of hundreds of volts to cause a glow discharge. To this end, a driving circuit of the PDP includes high voltage devices for generating a high voltage signal of hundreds of volts. For instance, the triple-electrode AC PDP is driven with a high voltage of about 200 to 300V.

Referring to FIG. 1, each cell of the triple-electrode AC PDP includes a front substrate 10 provided with row sustain electrodes pair 12A and 12B, and a rear substrate 18 provided with column address electrodes 20. The front substrate 10 and the rear substrate 18 are spaced in parallel to each other with having barrier ribs 24 therebetween. A mixture of gases, such as Ne-Xe or He-Xe, etc., is injected into a discharge space defined by the front substrate 10, the rear substrate 18 and the barrier ribs 24.

Any one electrode of the sustain electrode pair 12A and 12B is used as a scan/sustain electrode that responds to a scanning pulse applied in an address interval to cause an matrix discharge along with the address electrode 4 while responding to a sustaining pulse applied in a sustaining interval to cause a surface discharge along with the other adjacent sustain electrode. Also, one of the sustain electrode pair 12A or 12B is used as the scan/sustain electrode and the other is used as a common sustain electrode to which a sustaining pulse is applied commonly.

On the front substrate 10 provided with the sustain electrodes 12A and 12B, a dielectric layer 14 and a protective layer 16 are disposed. The dielectric layer 14 is responsible for limiting a plasma discharge current as well as accumulating a wall charge during the discharge. The protective layer 16 prevents damage of the dielectric layer 14 caused by the sputtering generated during the plasma discharge and improves the emission efficiency of secondary electrons. This protective layer 16 is usually made of magnesium oxide (MgO).

The rear substrate 18 is provided with a dielectric layer 26 covering the address electrodes 24. The barrier ribs 24 for dividing the discharge space extend perpendicularly at the rear substrate 18. A fluorescent material 22, excited by a vacuum ultraviolet lay to generate a visible light, is coated between the barrier ribs on the rear substrate.

As shown in FIG. 2, the cells 1 of the PDP are arranged on a panel 30 in a matrix. In each cell 1, scan/sustain electrode lines S1 to Sm, common sustain electrode lines C1 to Cm and address electrode lines D1 to Dn cross each other. The scan/sustain electrode lines S1 to Sm and the common sustain electrodes C1 to Cm comprise the sustain electrodes pair 12A and 12B in FIG. 1, respectively. The address electrode lines D1 to Dn comprise the address electrodes 20.

Such a triple-electrode AC PDP selects a cell to be displayed by a matrix discharge between the address electrode 20 and any one of the sustain electrodes 12A and 12B and thereafter sustains a discharge by a surface discharge between the sustain electrodes 12A and 12B. An ultraviolet generated by a sustaining discharge excites the fluorescent material 22.

At this time, a voltage required for a discharge is different depending on a distance between the electrodes and a wall charge amount accumulated in the dielectric layers 14 and 26, but it must be a high voltage of about 200 to 300V. To this end, the PDP driving apparatus requires a high voltage driving integrated circuit (IC). The high voltage signal generated from the high voltage driving IC is applied to a panel electrode comprising the sustain electrode pair 12A and 12B and the address electrode 20. The high voltage driving IC is mounted on a printed circuit board (PCB) connected to the panel 30.

As shown in FIG. 3, the high voltage driving IC includes a plurality of sets of a high voltage switch 42 supplied with a high-level voltage VDD and a low-level voltage VSS (or the ground GND), and a logic unit 40 for controlling the high voltage switch 42. The high voltage switch 42 includes a p-channel MOS FET T1 and an n-channel MOS FET T2 connected in a push-pull configuration. The high voltage switch selects any one of the high-level voltages under control of the logic unit 40 and applies it to a panel electrode 50. The panel electrode 50 corresponds to the sustain electrode pair 12A and 12B or the address electrode 20 and is provided on the panel 30.

The logic unit 40 responds to a logic input signal Lin to generate a low logic control signal. Then, since the p-channel MOS FET T1 is turned on, the high-level voltage VDD is applied, via a first voltage input line 31 and an output line 33, to the panel electrode 50. On the other hand, if a high logic control signal is generated from the logic unit 40, then the n-channel MOS FET T2 is turned on to apply the low-level voltage VSS, via a second voltage input line 32 and the output line 33, to the panel electrode 50.

Since the logic unit 40 and the high voltage switch 42 are connected, in series, to the panel electrode 50, their number is determined by the number of the panel electrode 50. In the case of a panel having a resolution of VGA class, the total number of address lines D1 to Dn supplied with red, green and blue data is 1920 (3×640). In this case, if the number of the output pin of each set of high voltage driving IC is 64, then 30 high voltage driving IC's are required to drive the address electrode lines D1 to Dn. Accordingly, as a resolution of the panel 30 increases to an SXGA class or more, a larger number of high voltage driving IC's are required. Since the high voltage driving IC is more expensive than the general low voltage driving IC, however, the cost of the PDP increases.

Moreover, since a larger number of high voltage driving IC's are required as a resolution of the panel 30 is improved into an SXGA class or more, the manufacturing cost of the PDP increases greatly. Further, the complexity of manufacturing process increases. Such problems are generated in the case of the triple-electrode AC PDP as well as in the case of a DC-type PDP causing a discharge by a DC voltage signal of more than hundreds of volts (V).

SUMMARY OF THE INVENTION

An object of the invention is to solve at least the above problems and/or disadvantages and to provide at least the advantages described hereinafter.

Accordingly, it is an object of the present invention to drive a plasma display panel with low voltage signals.

Another object of the invention is to reduce at least one of PDP cost, manufacturing cost, and manufacturing complexity.

A further object of the present invention is to provide a low voltage driving apparatus and method for a plasma display panel wherein a driving circuit are implemented with low voltage devices to drive the plasma display panel with low voltage signals.

In order to achieve these and other objects of the invention, a plasma display panel according to one aspect of the present invention includes a source electrode supplied with a voltage; and a trigger electrode opposite to the source electrode, whereby a discharge being generated between source electrode and trigger electrode to apply a voltage at each source electrode to each panel electrode.

A plasma display panel according to another aspect of the present invention includes a plurality of trigger electrodes responding to a low-level to cause an initial discharge; and a plurality of source electrodes receiving a high-level voltage from an external high-level voltage supply to cause the initial discharge and generating a secondary discharge along with the panel electrodes, whereby a voltage at each of the source electrode is transferred to each of panel electrodes by virtue of the secondary discharge.

A low-level voltage driving apparatus for a plasma display panel according to still another aspect of the present invention includes a driving circuit for generating a low-level voltage control signal; and a trigger driver, being provided at the plasma display panel, to apply a high-level voltage of each panel electrode in response to the low-level voltage control signal.

A method of driving a plasma display panel at a low-level voltage according to still another aspect of the present invention includes the steps of generating a low-level voltage control signal; and responding to the low-level voltage control signal to cause an initial discharge; and generating a secondary discharge between the panel electrode and the source electrode supplied with a high-level voltage by virtue of a transition of the initial discharge to apply the high-level voltage from the source electrode to the panel electrode.

Additional advantages, objects and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
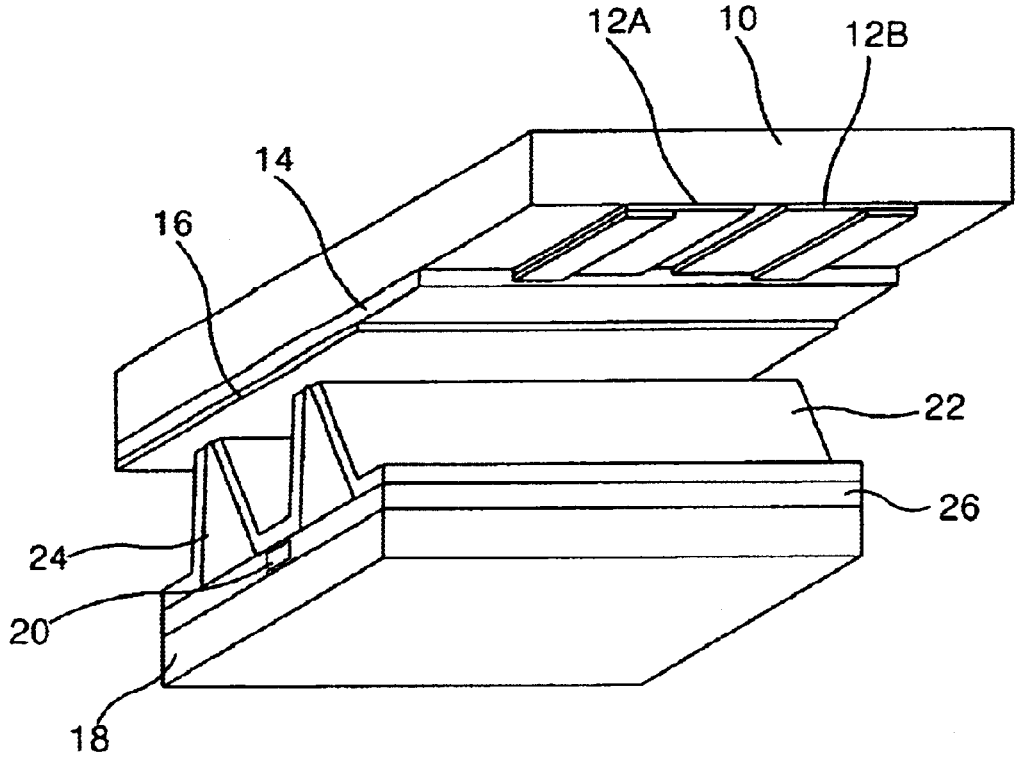
FIG. 1 RELATED ART
FIG. 1 is a schematic perspective view showing a structure of each discharge cell of a conventional AC plasma display panel.
Figure 2:
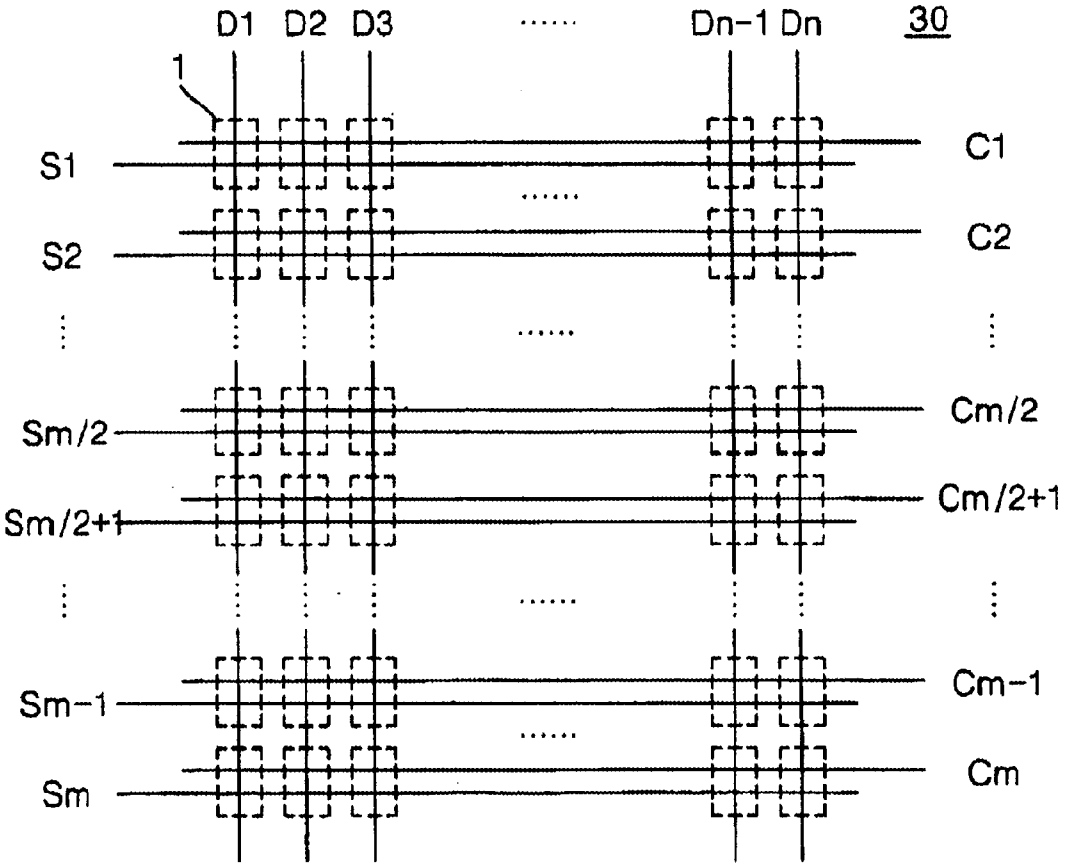
FIG. 2 RELATED ART
FIG. 2 is a plan view of the AC plasma display panel having the discharge cells as shown in FIG. 1 arranged in a matrix pattern.
Figure 3:
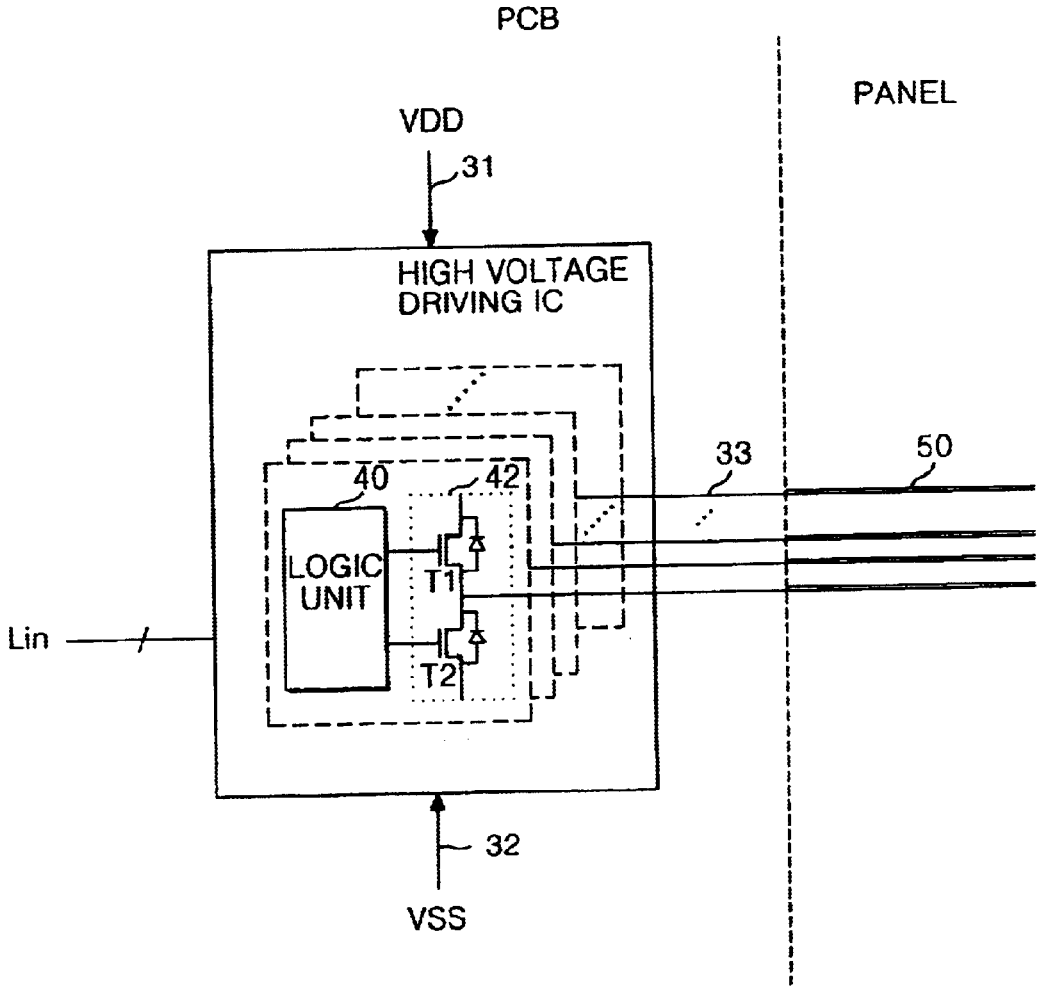
FIG.3 RELATED ART
FIG. 3 is a circuit diagram showing a configuration of the high voltage driver in the AC plasma display panel.
Figure 4:
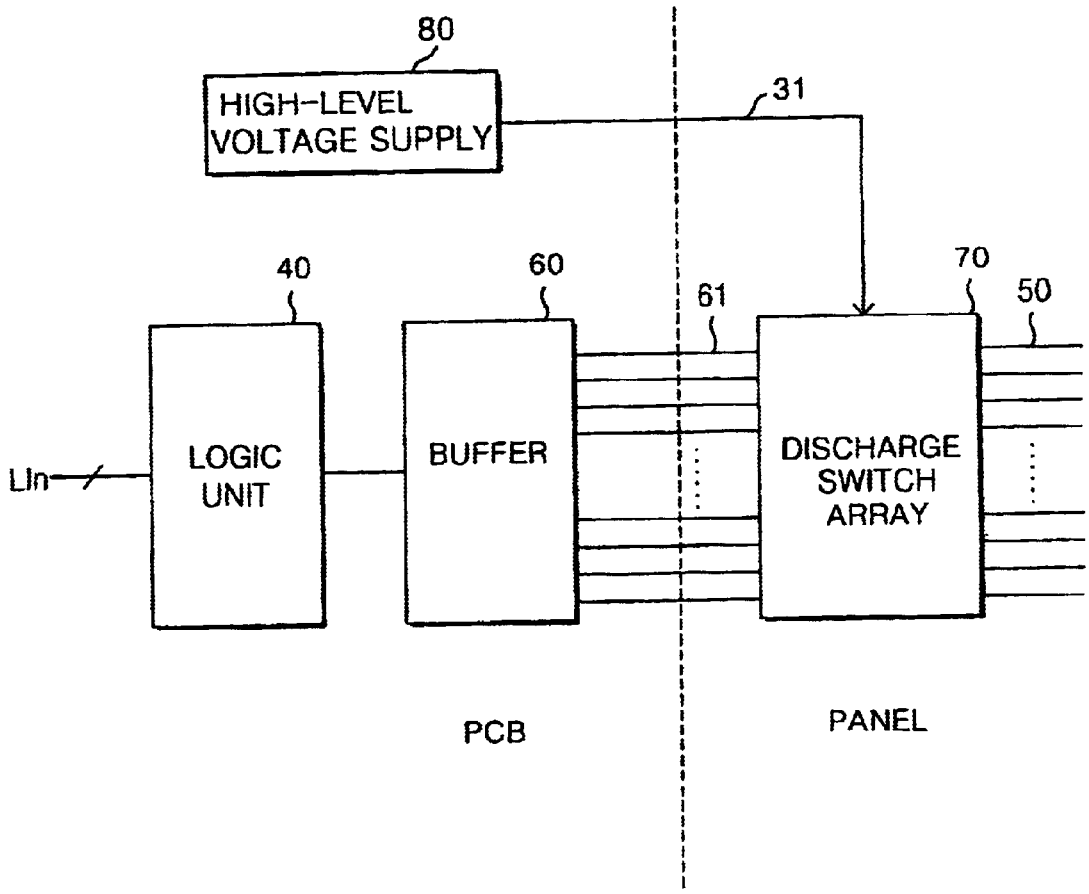
FIG. 4 is a block diagram showing a configuration of a low voltage driver in the plasma display panel according to a preferred embodiment of the present invention.

FIG. 4 illustrates a plasma display panel (PDP) having an electrode switching function according to the present invention and a driving apparatus thereof. The PDP includes a discharge switch array 70 provided on a substrate of a panel, and a logic unit 40 and a buffer 60 that are preferably provided on a PCB at the outer side of the panel to control the discharge switch array 70. The buffer 60 and the discharge switch array 70 are connected to each other with having output lines 61 crossing the PCB and the panel therebetween.

The discharge switch array 70 is provided on the panel to be connected between the output lines 61 of the buffer 60 and panel electrodes 50. The discharge switch array 70 receives a high-level DC voltage or pulse voltage from a high-voltage power supply 80 mounted on the PCB. The discharge switch array 70 responds to a low voltage control signal generated from the buffer 60 to cause a trigger discharge.

To this end, the discharge switch array 70 includes a plurality of discharge switches 70A connected between each panel electrode 50 and each input line 61. When a trigger discharge is caused by the discharge switch array 70, a high-level voltage is applied from the discharge switch 70A to the panel electrode 50.

The logic unit 40 responds to a logic input signal Lin and generates a control signal for controlling the discharge switch 70A. The buffer 60 shifts a voltage level of the control signal applied from the logic unit 40 by a driving voltage of the discharge switch 70A. Also, the buffer 60 plays a role to make a signal buffering between the logic unit 40 and the discharge switch array 70. A low voltage control signal outputted from the buffer 60 and applied to the discharge switch array 70 has a voltage level of about several or tens of volts.

Figure 5:
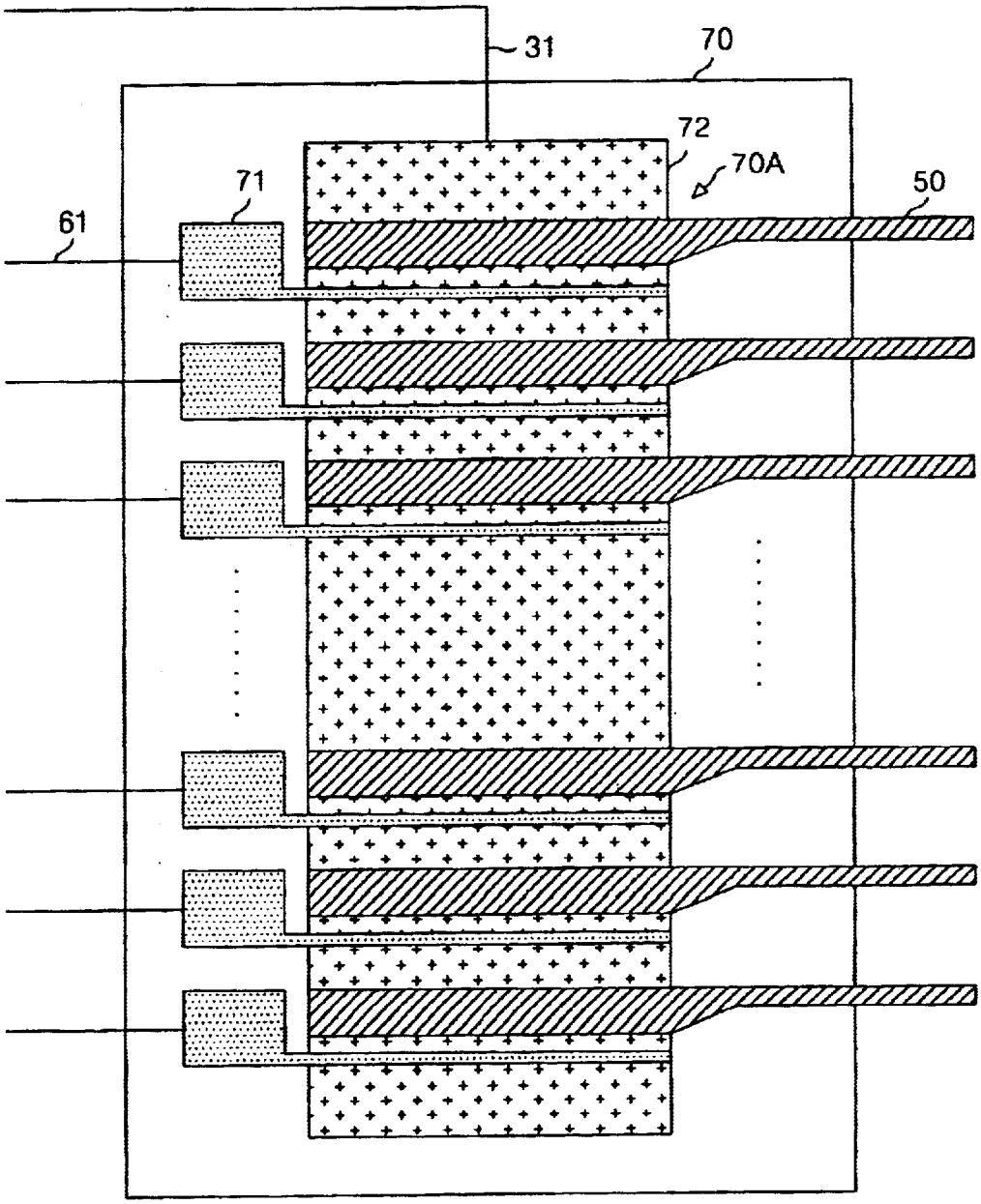
FIG. 5 and FIG. 6 illustrate a first preferred embodiment of the discharge switch shown in FIG. 4.
Figure 6:
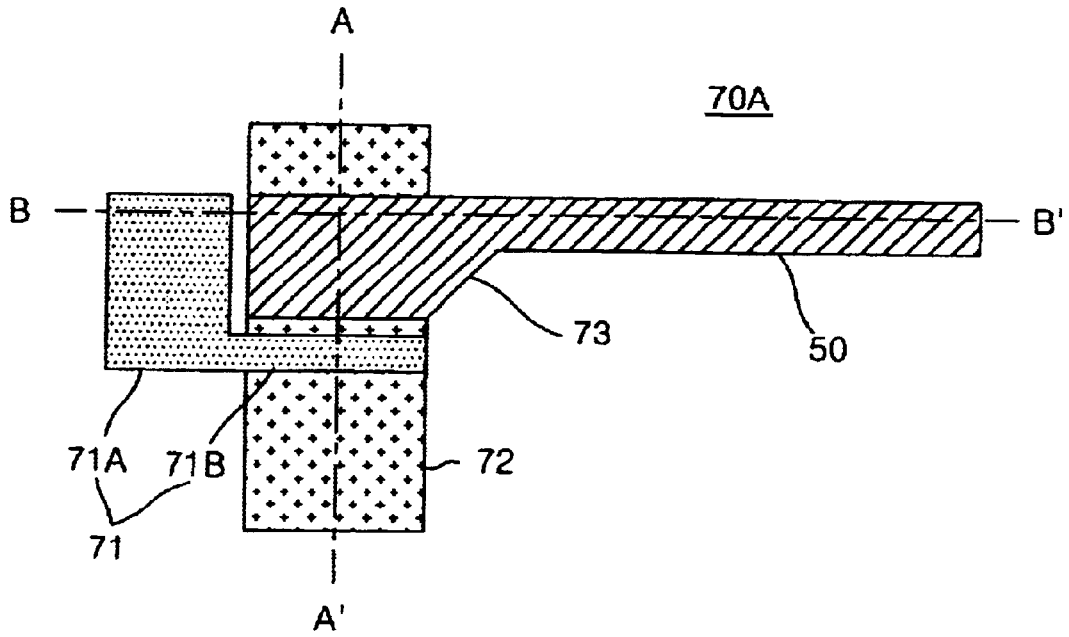

FIG. 5 and FIG. 6 represent a first preferred embodiment of the discharge switch array 70 shown in FIG. 4. In FIG. 5 and FIG. 6, the discharge switch 70A includes a trigger electrode 71, a source electrode 72 perpendicular to a source electrode 72, and a pad 73 formed in parallel to the trigger electrode 71 and opposed to the source electrode 72 with having a discharge space therebetween. The trigger electrode 71 includes a body 71A, and an arm 71B extended from one end of the body 71. The trigger electrode 71 surrounds the end and one side wall of the pad 73 by the body 71A and the arm 71B.

Figure 7:
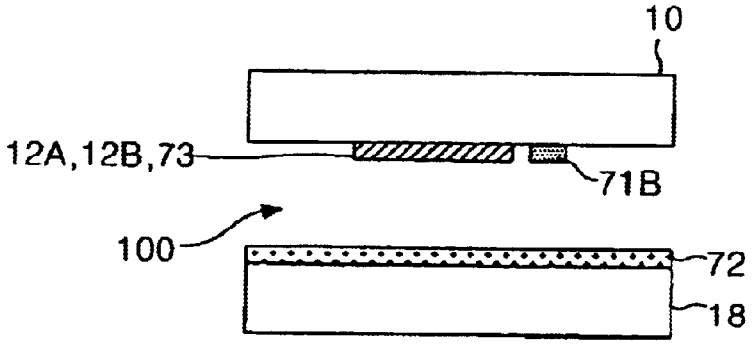
FIG. 7 is a section view of the discharge switch taken along the A–A' line in FIG. 6.

As shown in FIG. 6 and FIG. 7, the arm 71B is opposed to the source electrode 72 with having a discharge space 100 and is located at the same plane as the pad 36. A control signal of about several or tens of volts generated from the buffer 60 is applied to the trigger electrode 71. The source electrode 72 is commonly opposite to a plurality of trigger electrodes 71 and the panel electrodes 50 and receives a high-level DC voltage or pulse voltage from the high voltage power supply 80. The trigger electrode 71 is triggered when a voltage difference between a low-level voltage control signal applied thereto and a high-level voltage applied to the source electrode 72 becomes more than a voltage difference capable of causing a discharge.

By this trigger discharge, a high-level voltage at the source electrode 72 is delivered to the pad 73 connected to the panel electrode 50. The pad 73 is patterned along with the panel electrode 50 including the sustain electrode pair 12A and 12B and the address electrode 20 and formed integrally with the panel electrode 50. An overlapping area between the source electrode 72 and the pad 73 is determined in consideration of a current amount applied to the panel electrode 50.

When the overlapping area between the source electrode 72 and the pad 73 is large, a lot of current is applied to the panel electrode. Otherwise, when the overlapping area becomes small, a current applied to the panel electrode 50 is reduced. The trigger electrode 71, the source electrode 72 and the pad 73 are patterned along with the panel electrode provided on upper and lower substrates 10 and 18 by an electrode material vapor-deposition process and an etching process.

If a high-level voltage applied from the external high-level voltage supply 80 to the discharge switch 70A is a pulse voltage, then a low-level voltage control signal applied to the trigger electrode 71 must be synchronized with a high-level pulse voltage applied to the source electrode 72.

Figure 8:
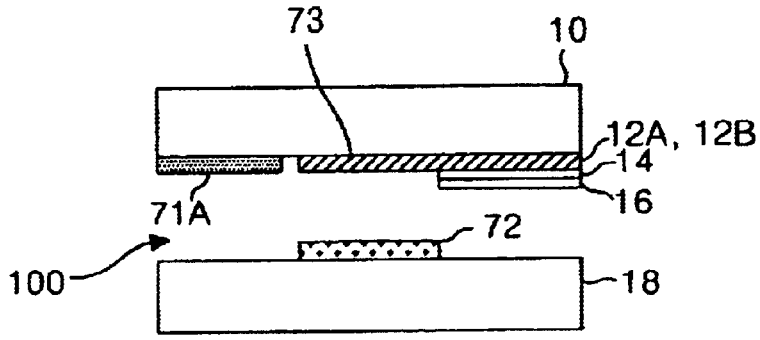
FIG. 8 is a section view of the discharge switch taken along the B–B' line in FIG. 6.

Referring to FIG. 7 and FIG. 8, there are shown the trigger electrode 71 formed on the upper substrate 10 in parallel to the sustain electrode pair 12A and 12B, and the source electrode 72 perpendicular to the panel electrode 50 and the trigger electrode 71 with having the discharge space therebetween. When the panel electrode 50 is the sustain electrode pair 12A and 12B as described above, the trigger electrode 71 is provided on the upper substrate while the source electrode 72 being provided on the lower substrate.

Otherwise, when the panel electrode 50 is the address electrode 20, the trigger electrode 71 is provided on the lower substrate 18 in parallel to the address electrode 20 while the source electrode being provided on the upper substrate 10.

Figure 9A:
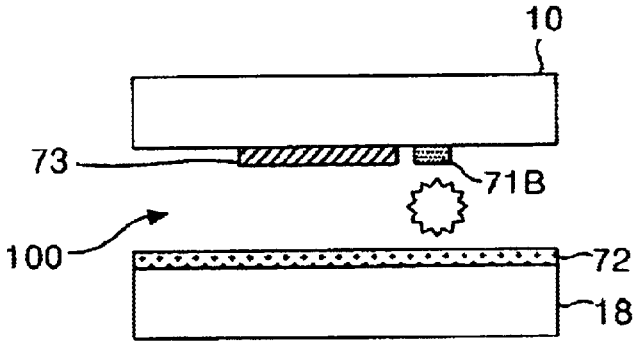
FIG. 9A and FIG. 9B are section views representing a switching operation of the discharge switch in FIG. 6.
Figure 9B:
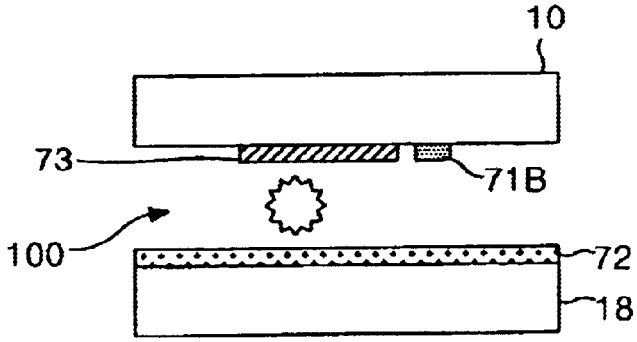

Hereinafter, a switching operation of the discharge switch 70A will be described with reference to FIG. 9A and FIG. 9B. A positive(+) high-level DC voltage or high-level pulse voltage is applied to the source electrode 72. When the positive(+) high-level voltage is applied to the source electrode 72 and, at the same time, a negative(−) control signal of tens of volts is applied to the trigger electrode 71, a trigger discharge is generated between the arm 71B of the trigger electrode 71 and the source electrode 72 as shown in FIG. 9A. Space charged particles generated by this trigger discharge is moved into the sustain electrode pad 73 along with plasma diffusion.

By the diffused space charges, a plasma discharge is generated at a discharge space between the sustain electrode pad 73 and the source electrode 72. By this plasma discharge, a current path is formed between the sustain electrode pad 73 and the source electrode 72. By this current path, a high-level voltage at the source electrode 72 is applied, via the sustain electrode pad 73, to the sustain electrode pair 12A and 12B or the address electrode 20.

If a control signal applied to the trigger electrode 71 changes to ground GND, then a trigger discharge between the trigger electrode 71 and the source electrode 72 is terminated to turn off the discharge switch 70A. Furthermore, if a high-level pulse voltage is applied to the source electrode 72, the threshold voltage for the trigger discharge can be further lowered. When the discharge switch 70A has been turned off, the source electrode 72 has the ground voltage GND and the panel electrode has been charged into a high-level voltage, thereby generating a reverse discharge between the panel electrode 50 and the source electrode 72. If the reverse discharge is generated in this manner, a voltage at the panel electrode 50 is easily discharged to the ground GND.

A current applied to the trigger electrode 71 is required to be limit at less than a desired level. This aims at preventing a short between the electrodes upon discharge between the trigger electrode 71 and the source electrode 72. If a short between the trigger electrode 71 and the source electrode 72 occurs, then a high-level voltage at the source electrode 72 is applied to the trigger electrode 71 rather than to the sustain electrode pad 73 upon discharge between the pad 73 and the source electrode 72.

Figure 10:
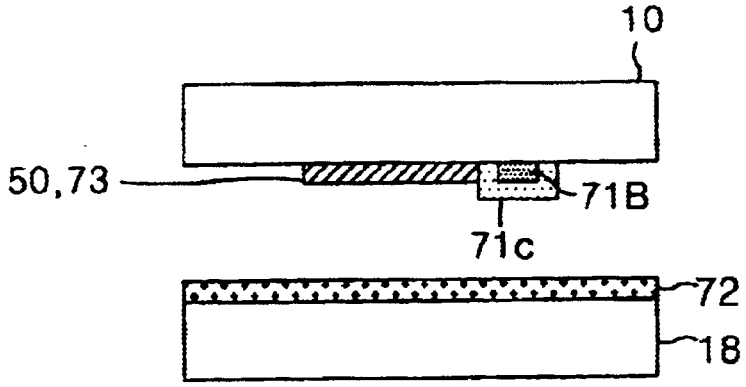
FIG. 10 is a section view representing a formation of a dielectric material on the trigger electrode in FIG. 6 in accordance with another preferred embodiment of the present invention.

To this end, it is desirable that a resistor for limiting a current is provided at the trigger electrode 71 as shown in FIG. 10. The current-limiting resistor can be formed by coating a dielectric material 71C on the trigger electrode 71. The dielectric material 71C plays a role to limit a current applied to the trigger electrode 71 as well as to protect the trigger electrode 71 from a sputtering caused by the discharge.

Figure 11:
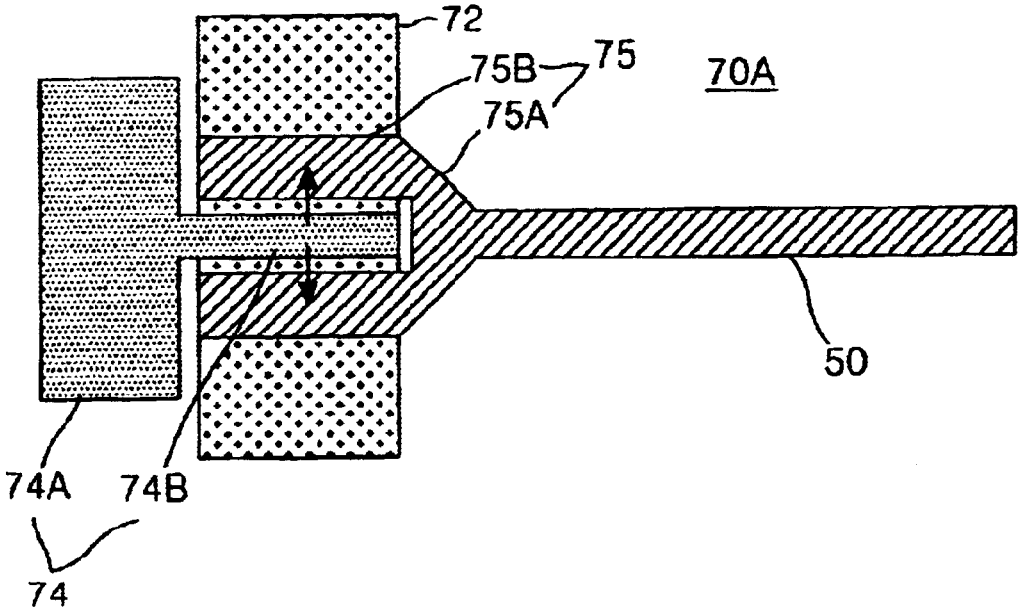
FIG. 11 illustrates a second preferred embodiment of the discharge switch shown in FIG. 4.

FIG. 11 represents a second preferred embodiment of the discharge switch 70A shown in FIG. 5. In FIG. 11, the discharge switch 70A includes a pad 75 surrounding each side of the trigger electrode 74. A low-level voltage control signal is applied from the buffer 60 to a trigger electrode 74. The trigger electrode 74 includes a body 74A connected to the output line 61 of the buffer 60, and an arm 74B extended from the center of the body 74A into a sustain electrode pad 75. The arm 74B is opposite to the source electrode 72 with having a discharge space 100 therebetween and provided, in parallel, on the same plane as the pad 75.

The source electrode 72 is perpendicular to the arm 74B of the trigger electrode 74 and the pad 75 and supplied with a high-level voltage. The source electrode 72 is trigger-discharged along with the trigger electrode 74 and thereafter is discharged along with the pad 75, thereby applying a high-level voltage to the pad 75. The pad 75 includes a body 75A connected to the panel electrode 50, and an arm 75B surrounding the arm 74B of the trigger electrode 74 at each edge of the body 75A.

By virtue of the arm 75B of the arms 75B of the pad electrode 75 adjacent to each side of the arm 74B of the trigger electrode 74, a plasma discharge between the trigger electrode 74 and the source electrode 72 is diffused into each side thereof as indicated by an arrow in FIG. 11. Since the plasma discharge is diffused into each side thereof, a switching turn-on time is shortened to that extent to rapidly apply a high-level voltage at the source electrode 72 to the panel electrode 50. Also, if the plasma discharge is diffused to each side thereof, then a voltage required for a trigger discharge may be lowered.

Figure 12:
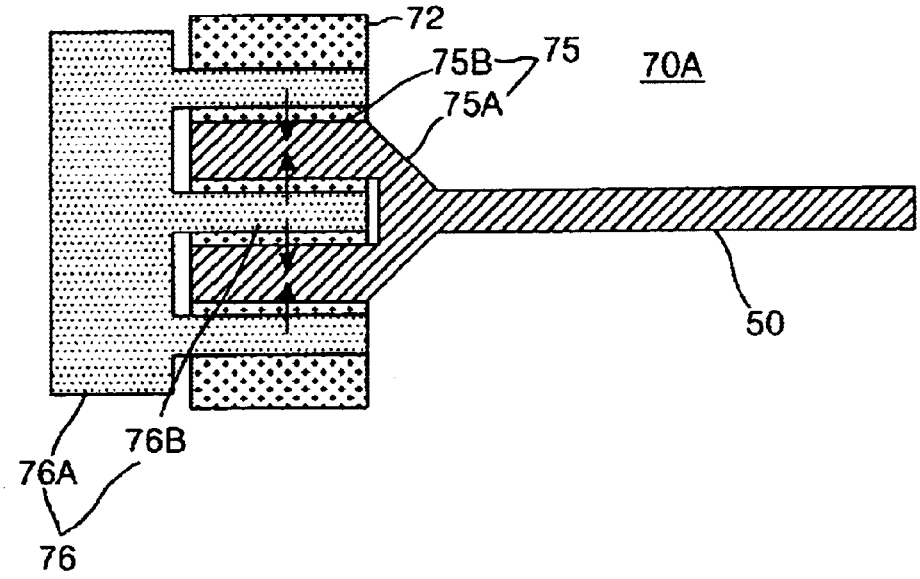
FIG. 12 illustrates a third preferred embodiment of the discharge switch shown in FIG. 4.
Figure 13:
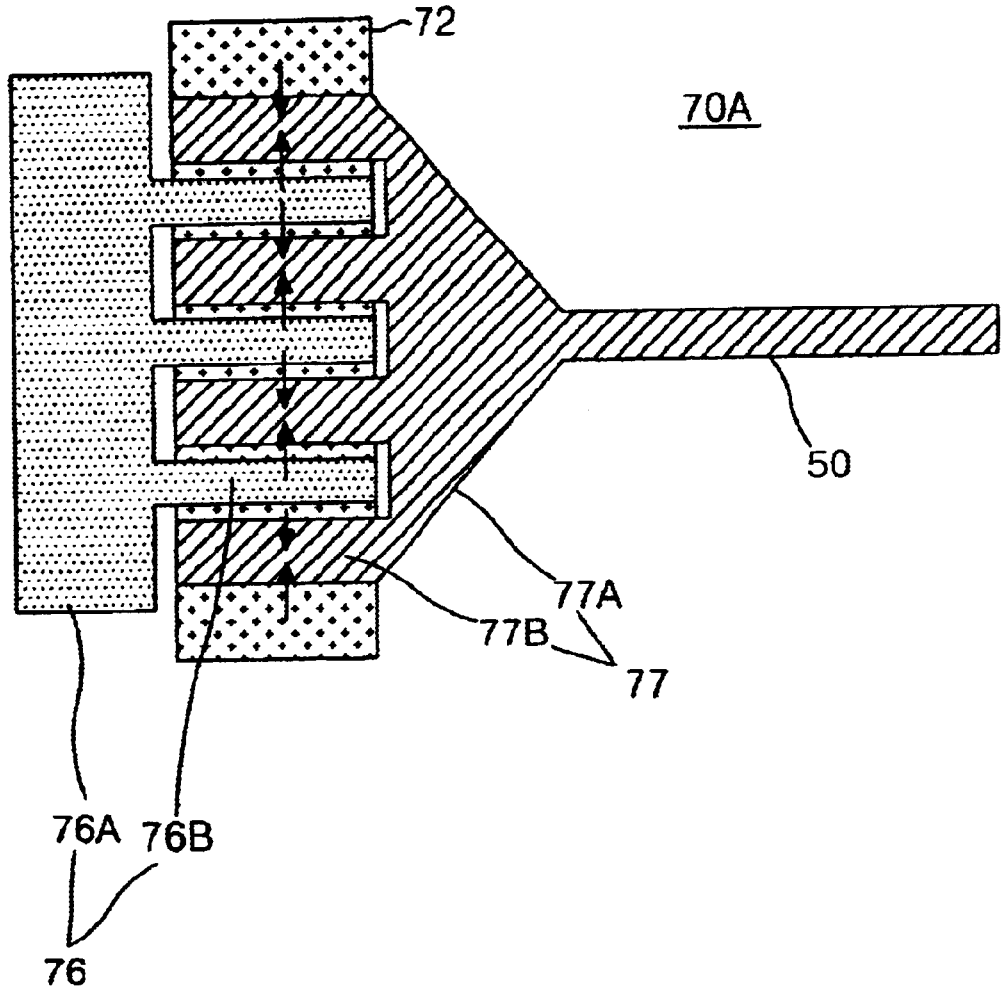
FIG. 13 illustrates a fourth preferred embodiment of the discharge switch shown in FIG. 4.

As shown in FIG. 12 and FIG. 13, if the number of arms 76B of a trigger electrode 76 and arms 75B and 77B provided at pads 75 and 77 increases, then a switching turn-on time and a voltage required for a trigger discharge can be more lowered. In this case, the arms 75B and 77B of the pads 75 and 77 are positioned between the arms 76B of the trigger electrode 76.

As described above, according to the present invention, a high-level voltage is not applied directly to the panel electrode such as the sustain electrode and the address electrode, etc. but is applied to the panel electrode by virtue of a discharge switching between the trigger electrode and the source electrode supplied with a high-level voltage. Accordingly, the high-level voltage driving IC for applying a high-level voltage directly to the panel electrode can be replaced by a low-level voltage driving IC, thereby implementing a low manufacturing cost of the driving circuitry. As a result, according to the present invention, a high-level voltage can be applied to the plasma display panel by virtue of a low-level voltage control signal applied from the driving circuit, so that the plasma display panel can be driven with a low-level voltage. Further, the present invention and its teachings are applied to AC PDP, a radio frequency PDP or a DC type PDP.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses, are intended to cover the structures described herein as performing the recited function and not only structural equivalents but also equivalent structures.

What is claimed is:

1. A plasma display panel comprising a discharge switch array for transferring power between electrodes, comprising:

a source electrode supplied with a first voltage; and a trigger electrode opposed to the source electrode so as to be spaced apart, said trigger electrode being supplied with a second voltage, wherein a discharge is generated in the space between source electrode and trigger electrode to conduct a third voltage to a panel electrode from the source electrode.

2. The plasma display panel of claim 1, wherein the source electrode and the trigger electrode are provided to face each other on an upper substrate and a lower substrate, respectively.

3. The plasma display panel of claim 1, wherein the trigger electrode is provided adjacently on the same plane as the panel electrode.

4. The plasma display panel of claim 1, wherein the trigger electrode comprises:

a body supplied with a low-level voltage control signal; and at least one arm partially extending from the body into the panel electrode to surround the panel electrode.

5. The plasma display panel of claim 4, wherein the panel electrode comprises:

at least one arm extending into the trigger electrode in such a manner to be positioned between the arms of the trigger electrode.

6. A plasma display panel provided with a plurality of panel electrodes to display a picture by a discharge between the panel electrodes, comprising:

a plurality of trigger electrodes responding to a low-level signal to cause a first discharge; and a plurality of source electrodes receiving a high-level voltage from an external high-level voltage supply to cause the first discharge and generating a secondary discharge along with the panel electrodes, wherein a voltage at each of the source electrode is applied to each of panel electrodes by the secondary discharge.

7. The plasma display panel of claim 6, wherein each of the source electrodes and each of the trigger electrodes are provided on an upper substrate and a lower substrate, respectively, in such a manner to be opposed to each other to create a discharge space therebetween.

8. The plasma display panel of claim 6, wherein the trigger electrode is provided adjacently on the same plane as the panel electrode.

9. The plasma display panel of claim 6, wherein the trigger electrode comprises:

a body supplied with a low-level voltage control signal; and at least one arm extending from the body into the panel electrode to surround the panel electrode.

10. The plasma display panel of claim 9, wherein the panel electrode comprises:

at least one arm extending into the trigger electrode in such a manner to be positioned between the arms of the trigger electrode.

11. A driving apparatus for a plasma display panel provided with a plurality of panel electrodes to cause a discharge within cells, comprising:

a driving circuit for providing a low-level voltage control signal; and a trigger driver, being provided at the plasma display panel, to conduct a high-level voltage to each panel electrode in response to the low-level voltage control signal, wherein the trigger driver comprises:

a trigger electrode supplied with the low-level voltage control signal; and a source electrode for generating a discharge along with the trigger electrode to conduct the high-level voltage to each panel electrode.

12. The voltage driving apparatus of claim 11, wherein each of the source electrodes and each of the trigger electrodes are provided on an upper substrate and a lower substrate, respectively, in such a manner to be opposed to each other to create a discharge space therebetween.

13. The voltage driving apparatus of claim 11, wherein the trigger electrode is provided adjacently on the same plane as the panel electrode.

14. The voltage driving apparatus of claim 11, wherein the trigger electrode comprises:

a body supplied with the low-level voltage control signal; and at least one arm extending from the body into the panel electrode to partially surround the panel electrode.

15. The voltage driving apparatus of claim 11, wherein the panel electrode includes at least one arm extending into the trigger electrode in such a manner to be positioned between the arms of the trigger electrode.

16. A method of driving a plasma display panel provided with a plurality of panel electrodes to cause a discharge within cells, comprising:

generating a low-level voltage control signal;

responding to the low-level voltage control signal to cause a first discharge; and generating a secondary discharge between each of the plurality of panel electrodes and a source electrode supplied a high-level voltage by virtue of a transition of the first discharge to conduct the high-level voltage from the source electrode to the panel electrode.

17. The method of claim 16, wherein the low-level voltage signal is generated from the driving circuit connected to the plasma display panel to be applied to the trigger electrode opposed to the source electrode with having the discharge space therebetween.

18. The method of claim 16, wherein the source electrode generates the first discharge along with the trigger electrode to conduct the high-level voltage to the panel electrode.

19. A plasma display apparatus comprising:

a plurality of sustain electrodes in a first direction;

a plurality of address electrodes in a second direction which is different from the first direction;

a plurality of discharge cells, each cell being formed at an intersection of corresponding sustain electrode and address electrode;

a plurality of panel electrodes, each panel electrode being coupled to at least one of corresponding sustain electrode and address electrode;

a discharge switch array coupled to the plurality of panel electrodes, said discharge switch array having a plurality of panel electrode layers, each panel electrode layer being coupled to a corresponding panel electrode, a plurality of trigger electrodes, each trigger electrode formed adjacent to a corresponding panel electrode layer, and at least one source electrode layer formed on a different plane than the plurality of panel electrode layers and the plurality of trigger electrodes such that a plurality of discharge spaces is formed between the corresponding panel electrode layer and at least one source electrode layer and between the corresponding trigger electrode and at least one source electrode layer.

20. The plasma display apparatus of claim 19, further comprising:

a logic unit for providing a control signal and for controlling the discharge switch array; and a buffer for buffering the control signal and coupled to the discharge switch array.

21. The plasma display apparatus of claim 20, wherein the logic unit and the buffer are formed on a printed circuit board, and the discharge switch array is formed on a display panel.

22. The plasma display apparatus of claim 19, wherein said plurality of panel electrode layers and trigger electrodes are formed on a first substrate and at least one source electrode layer is formed on a second substrate.

23. The plasma display apparatus of claim 20, further comprising a voltage generator coupled to the discharge switch array for supplying a high level voltage to at least one source electrode layer.

24. The plasma display apparatus of claim 23, wherein the control signal is a low level voltage which is applied to a corresponding trigger electrode.

25. The plasma display apparatus of claim 20, wherein each trigger electrode has an arm formed parallel to a corresponding panel electrode layer such that each trigger electrode is formed adjacent to a side and an end of the corresponding panel electrode layer.

26. The plasma display apparatus of claim 19, wherein each panel electrode layer has a plurality of arms extending over the at least one source electrode layer, and a corresponding trigger electrode is formed between the plurality of arms.

27. The plasma display apparatus of claim 19, wherein each panel electrode layer has a plurality of arms and each trigger electrode layer has a plurality of arms, and the plurality of arms of each panel electrode layer and each trigger electrode layer are meshed.

28. The plasma display apparatus of claim 19, wherein a dielectric layer is formed over each trigger electrode to form a resistor.

29. A plasma display panel having sustain electrodes, address electrodes, and discharge cells, wherein the improvement comprises a discharge switch array coupled to at least one of the sustain and address electrodes, said discharge switch array comprising:

a plurality of panel electrode layers, each panel electrode layer being coupled to at least one of sustain and address electrodes, a plurality of trigger electrodes, each trigger electrode formed adjacent to a corresponding panel electrode layer, and at least one source electrode layer formed on a different plane than the plurality of panel electrode layers and the plurality of trigger electrodes such that a plurality of discharge spaces is formed between the corresponding panel electrode layer and at least one source electrode layer and between the corresponding trigger electrode and at least one source electrode layer.

30. A driving apparatus for a plasma display apparatus comprising:

a plurality of panel electrode layers;

a plurality of trigger electrodes, each trigger electrode formed adjacent to a corresponding panel electrode layer and coupled for receiving a low level voltage signal; and at least one source electrode layer formed on a different plane than the plurality of panel electrode layers and the plurality of trigger electrodes such that a plurality of discharge spaces is formed between the corresponding panel electrode layer and at least one source electrode layer and between the corresponding trigger electrode and at least one source electrode layer, at least one source electrode layer being coupled for receiving a high voltage level signal such that a threshold voltage difference is created between each trigger electrode and the source electrode layer to cause a first discharge in the discharge space between the corresponding trigger electrode and the source electrode layer, the first discharge being diffused into the discharge space between the corresponding panel electrode layer and the source electrode layer.

* * * * *